US008976079B2

(12) United States Patent
Besnard et al.

(10) Patent No.: US 8,976,079 B2
(45) Date of Patent: Mar. 10, 2015

(54) SMART DUAL DISPLAY SYSTEM

(75) Inventors: Nicolas Besnard, Saint Medard (FR); Arnaud Bouchet, Pessac (FR)

(73) Assignee: Thales, Neuilly sur Seine (FR)

( * ) Notice: Subject to any disclaimer, the term of this patent is extended or adjusted under 35 U.S.C. 154(b) by 342 days.

(21) Appl. No.: 13/566,888

(22) Filed: Aug. 3, 2012

(65) Prior Publication Data

US 2013/0033503 A1 Feb. 7, 2013

(30) Foreign Application Priority Data

Aug. 5, 2011 (FR) ..... 11 02460

(51) Int. Cl.

| | |
|---|---|
| ***G09G 5/00*** | (2006.01) |
| ***G09G 5/397*** | (2006.01) |
| *G09G 5/14* | (2006.01) |

(52) U.S. Cl.

CPC ..... *G09G 5/397* (2013.01); *G09G 2330/08* (2013.01); *G09G 2360/04* (2013.01); *G09G 2360/06* (2013.01); *G09G 2380/12* (2013.01); *G09G 5/14* (2013.01)

USPC ..... 345/1.3; 345/87

(58) Field of Classification Search

None

See application file for complete search history.

(56) References Cited

U.S. PATENT DOCUMENTS

| | | | | |
|---|---|---|---|---|
| 6,232,932 | B1 * | 5/2001 | Thorner | 345/1.3 |
| 6,262,695 | B1 * | 7/2001 | McGowan | 345/1.1 |
| 6,297,785 | B1 * | 10/2001 | Sommer et al. | 345/1.1 |
| 6,297,786 | B1 * | 10/2001 | Kakuta et al. | 345/1.1 |
| 6,977,666 | B1 * | 12/2005 | Hedrick | 345/690 |
| 6,982,682 | B1 * | 1/2006 | Kaulgud et al. | 345/1.1 |
| 7,538,781 | B2 * | 5/2009 | Gyde et al. | 345/629 |
| 7,808,447 | B1 * | 10/2010 | Cook | 345/1.3 |
| 8,212,740 | B1 * | 7/2012 | Harris | 345/1.1 |
| 2003/0011549 | A1 * | 1/2003 | Murahashi et al. | 345/87 |
| 2005/0231390 | A1 * | 10/2005 | Crane et al. | 340/945 |
| 2005/0280601 | A1 * | 12/2005 | Fukue | 345/1.1 |
| 2005/0284984 | A1 * | 12/2005 | De Lauzun et al. | 244/129.1 |
| 2006/0022968 | A1 * | 2/2006 | Kondo et al. | 345/211 |
| 2007/0035470 | A1 * | 2/2007 | Lee et al. | 345/1.1 |
| 2007/0294454 | A1 * | 12/2007 | Danilak | 710/305 |
| 2009/0112380 | A1 * | 4/2009 | Nutaro et al. | 701/14 |

(Continued)

FOREIGN PATENT DOCUMENTS

| | | |
|---|---|---|
| EP | 1 762 825 A2 | 3/2004 |
| WO | 02/05019 A2 | 1/2002 |

OTHER PUBLICATIONS

Antoine de Reus, et al., "Three Large LCD Cockpit Concept for Retrofit Applications", The 23rd Salt Lake City Digital Avionics Systems Conference, Oct. 24-28, 2004, pp. 6.D.5-11, IEEE, Piscataway, NJ, USA, XP010764890.

*Primary Examiner* — Antonio Xavier

(74) *Attorney, Agent, or Firm* — Baker & Hostetler LLP

(57) ABSTRACT

A secure display system for a movable object, such as an aircraft, includes: a screen comprising at least two independent matrices formed of pixels, each of the matrices being controlled by an independent graphic channel; a light box comprising at least two independent subassemblies, each backlighting each half-screen; two bypass functions, a bypass function being associated with a graphic channel, a bypass function being linked to an input of one of the matrices; a central module having a function of mixing the data originating from the two independent graphic channels, and a function of separating said data, said separation module being connected to said bypass functions; each graphic channel comprising image-generation means; and two power supply means. The display system may be used in an aeroplane.

12 Claims, 7 Drawing Sheets

(56) References Cited

U.S. PATENT DOCUMENTS

2010/0289671 A1* 11/2010 Hauty et al. ..... 340/945
2010/0289963 A1* 11/2010 Lefort et al. ..... 348/659
2010/0295999 A1* 11/2010 Li ..... 348/705
2012/0105253 A1* 5/2012 Lillis et al. ..... 340/945

* cited by examiner

SMART DUAL DISPLAY SYSTEM

CROSS-REFERENCE TO RELATED APPLICATION

This application claims priority to foreign French patent application No. FR 1102460, filed on Aug. 5, 2011, the disclosure of which is incorporated by reference in its entirety.

FIELD OF THE INVENTION

The subject of the present invention relates to a secure display system notably a full-screen display system for a screen of LCD, for "Liquid Crystal Display" technology comprising two display half-screens that can be controlled independently of one another. The display of the data is carried out in one or more windows occupying all or a portion of the screen.

The system according to the invention is applied, for example, on aircraft instrument panels. Current instrument panels comprise essentially display screens making it possible to provide the pilots with the information necessary for piloting, for navigation and more generally for the accomplishment of the mission in progress. The crew can interact by means of human-machine interfaces with these screens in order to select, check or modify the data and the parameters displayed.

BACKGROUND

In the avionics field, for example, aeroplanes that transport passengers have relatively small cockpits in which the successful integration of the elements necessary for piloting, for navigation, for monitoring and for communications is essential for the security of the flight and for optimizing the workload of the crew.

Currently, the technology makes it possible to produce large display screens, typically with a diagonal equal to or greater than 15 inches with an excellent resolution. In order to allow the display of new avionics functions, the size of the display screens is significantly increased over that which existed previously. Since cockpits have a generally restricted size, the constraints of installation lead to the consideration of display systems comprising no more than 3 large screens. The total number of screens is therefore lower compared with what was done before. This reduced number of screens poses problems of availability of the information necessary for piloting, for navigation, in case of a simple failure that can simultaneously cause the loss of several functions displayed on one and the same screen.

To achieve the objectives of availability and of security of operation required in the air-transport field, one solution consists in proposing displays having a duplicated internal architecture. The technical problem posed is then to find an architecture solution that makes it possible to satisfy at the same time the objectives of availability, of security of operation and of operational performance: guarantee that there is no single failure that leads to the loss of the whole screen, capacity for display in full-screen mode, and optimal use of the computing and graphic generation resources available.

The existing solutions multiply the number of small-sized screens in a cockpit leading to additional costs, wiring and weight. The number of screens can vary from 4 to 8 and even more. Another solution set out in patent application FR 1101386 of the Applicant consists in using a 3-screen display system while ensuring availability of the avionics system.

SUMMARY OF THE INVENTION

The subject of the invention relates to a secure display system for a movable object, such as an aircraft, characterized in that it comprises at least the following elements:

- a screen E consisting of at least two independent matrices $E_1$, $E_2$ formed of pixels, each of the matrices being controlled by an independent graphic channel $C_1$, $C_2$, the said matrices having independent inputs $I_1$, $I_2$,
- a light box consisting of at least two independent subassemblies $B_1$, $B_2$, each backlighting each half-screen $E_1$, $E_2$,
- two bypass functions $T_1$, $T_2$, a bypass function $T_1$, $T_2$ being associated with a graphic channel $C_1$, $C_2$, each of the two bypass functions being associated on a one-to-one basis with one of the two graphic channels and controlled by the associated graphic channel, each bypass function connecting the input of each matrix $E_1$, $E_2$ to the signal of the graphic channel that controls it or to the output of the separation module,
- a central module having a function of mixing the data originating from the two independent graphic channels $C_1$, $C_2$, and a function of separating the said data, the said separation module being connected to the said bypass functions $T_1$, $T_2$,
- each graphic channel $C_1$, $C_2$ comprising image-generation means,
- a first power supply unit $A_1$ and a second power supply unit $A_2$.

The system may comprise a synchronization module providing the synchronization between the two graphic channels $C_1$, $C_2$.

The system may also comprise a monitoring means connected to the said graphic channels $C_1$ and $C_2$.

According to one embodiment, the system comprises a third power supply unit powering the said central module.

The screen E is, for example, a liquid crystal screen consisting of two independent matrices $E_1$, $E_2$ of pixels.

According to one embodiment, the image-generation means of each graphic channel $C_1$, $C_2$ generate data allowing the independent display of two half-images on the two half-portions forming the screen.

According to another embodiment, the image-generation means of a single graphic channel $C_1$, $C_2$ generate data allowing the display of a full-screen image on the two half-portions forming the screen.

Each of the graphic channels generates data allowing, for example, a display on one or more windows distributed over the said screen and another display surface corresponding to the totality of the said screen E.

The display system according to the invention is for example used in an aeroplane comprising one, two or three LCD screens.

BRIEF DESCRIPTION OF THE DRAWINGS

Other features and advantages of the present invention will become more evident on reading the following description given as an illustration and being in no way limiting that is appended with the figures which represent.

DETAILED DESCRIPTION

In order to ensure that the architecture of the display system according to the invention is understood, the following example is given in the context of an application in the avionics field.

Figure 1:
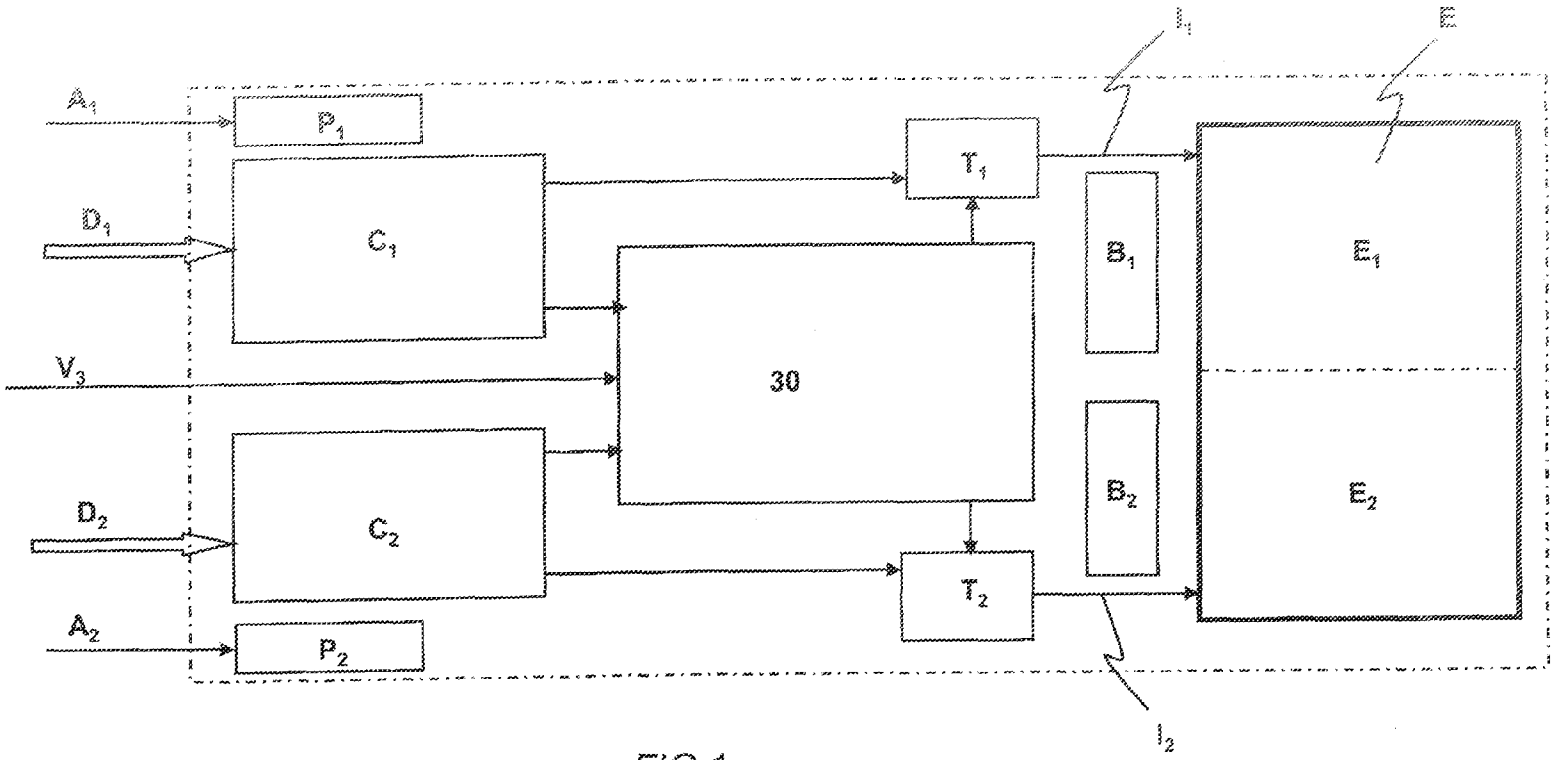
FIG. 1, an example of an architecture of a display according to the invention, FIG. 2, a block diagram of the operating principle of a display of FIG. 1, FIG. 3, an illustration of a full-screen operation, FIG. 4, an example of operation in full-dual mode, using two display systems, FIG. 5, an example of operation in full-screen mode, FIG. 6, an example of operation in full-screen mode with video, and FIG. 7, an example of operation in multi-window full-screen mode.

As an illustration, FIG. 1 represents an example of architecture of a display device according to the invention. The architecture is based on the use of a screen E of the LCD type or any other similar technology consisting of at least two half-screens $E_1$, $E_2$, each half-screen having its own input respectively $I_1$, $I_2$. The dual panel E is addressed by half-side and guarantees an absence of common-mode failure on the screen. A screen consists, for example, of two matrices of elementary pixels which are addressed by two electronic control or addressing assemblies that are totally separated making it possible to create two stand-alone images. As an example, the size of the screen may be 15.4 inches which corresponds to a screen diagonal of 39 centimetres. The screen E is backlit by a light box consisting of two independent subassemblies $B_1$, $B_2$, each backlighting each half-screen $E_1$, $E_2$. This light box can be provided by light-emitting diodes.

The display device according to the invention comprises two graphic generation channels $C_1$, $C_2$.

The graphic generation channel $C_1$ comprises hardware and software resources allowing the acquisition of data, the processing of the data and the associated graphic processing. $C_1$ comprises means for interconnection with the rest of the avionics system, image-generation means making it possible to generate images on the half-screen $E_1$ or on the full screen E. These image-generation means are linked to a central module or assembly 30 and to a bypass function $T_1$ which will be described below.

Similarly, the second graphic-generation channel $C_2$ comprises hardware and software resources allowing the acquisition of data, the processing of the data and the associate graphic processing. $C_2$ comprises means 20 for interconnection with the rest of the avionics system, linked to image-generation means 21 making it possible to generate images on the half-screen $E_2$ or on the full screen E. These image-generation means are linked to the central module 30 and to a bypass function $T_2$ described below.

The display device according to the invention comprises bypass means $T_1$, $T_2$ for the signals originating from the two display systems $C_1$, $C_2$. The bypass function $T_1$, $T_2$ associated with each of the channels $C_1$, $C_2$ makes it possible notably to alternate between a "full-dual" operating mode and a full-screen operating mode of the screen E. Each of the two bypass functions $T_1$, $T_2$ is associated on a one-to-one basis with one of the two graphic channels and controlled by the associated graphic channel, each bypass function linking the input of each matrix to the signal of the graphic channel that controls it or to the output of the separation module.

The display device according to the invention comprises a central module 30 making it possible to compose full-screen images based on the images generated by each of the graphic channels $C_1$, $C_2$ or based on the images generated by only one of the two graphic channels $C_1$ or $C_2$, optionally mixed with an external video source $V_3$.

The central module 30 and the graphic generation channels are adapted to envisage various operating modes:

1) the full-screen image is generated by a single graphic channel, the other graphic channel generating no image but being able to substitute for the first in the event of a failure of the latter;
2) each graphic channel generates one or more windows distributed over the screen. These windows are disconnected and complementary so that all of these windows cover the whole of the display surface of the full screen;
3) each graphic channel generates a display surface corresponding to the totality of the full screen. The two display surfaces thus generated are superposed and "mixed" by the mixing function according to a predefined priority criterion;
4) the foregoing operating modes 2 and 3 can be combined to allow greater flexibility of implementation of the display functions.

These operating modes make it possible to make best use of the computing resources and graphic resources available, to distribute the processing on each of the channels in order to ensure a better overall performance of the product, and/or to provide a physical segregation between two display functions. A few examples of operation are given in FIGS. 3 to 7.

The image-generation means of each of the channels generate images representative of the data necessary for piloting, for navigation, for controlling the craft or for travelling at an airport. These main types of display are known by the abbreviation "EFIS" for "Electronic Flight Instrument System" and the abbreviation "ECAM" for "Electronic Centralized Aircraft Monitoring". The corresponding displays as a function of the data are called:

piloting data: "PFD" the acronym for "Primary Flight Display", navigation data: "ND" the acronym for "Navigation Display", engine control and alarm management data: "EWD" the acronym for "Engine Warning Display", general aeroplane systems data: "SD" the acronym for "System Display", airport data: "ANF" the acronym for "Airport Navigation Function".

Figure 2:
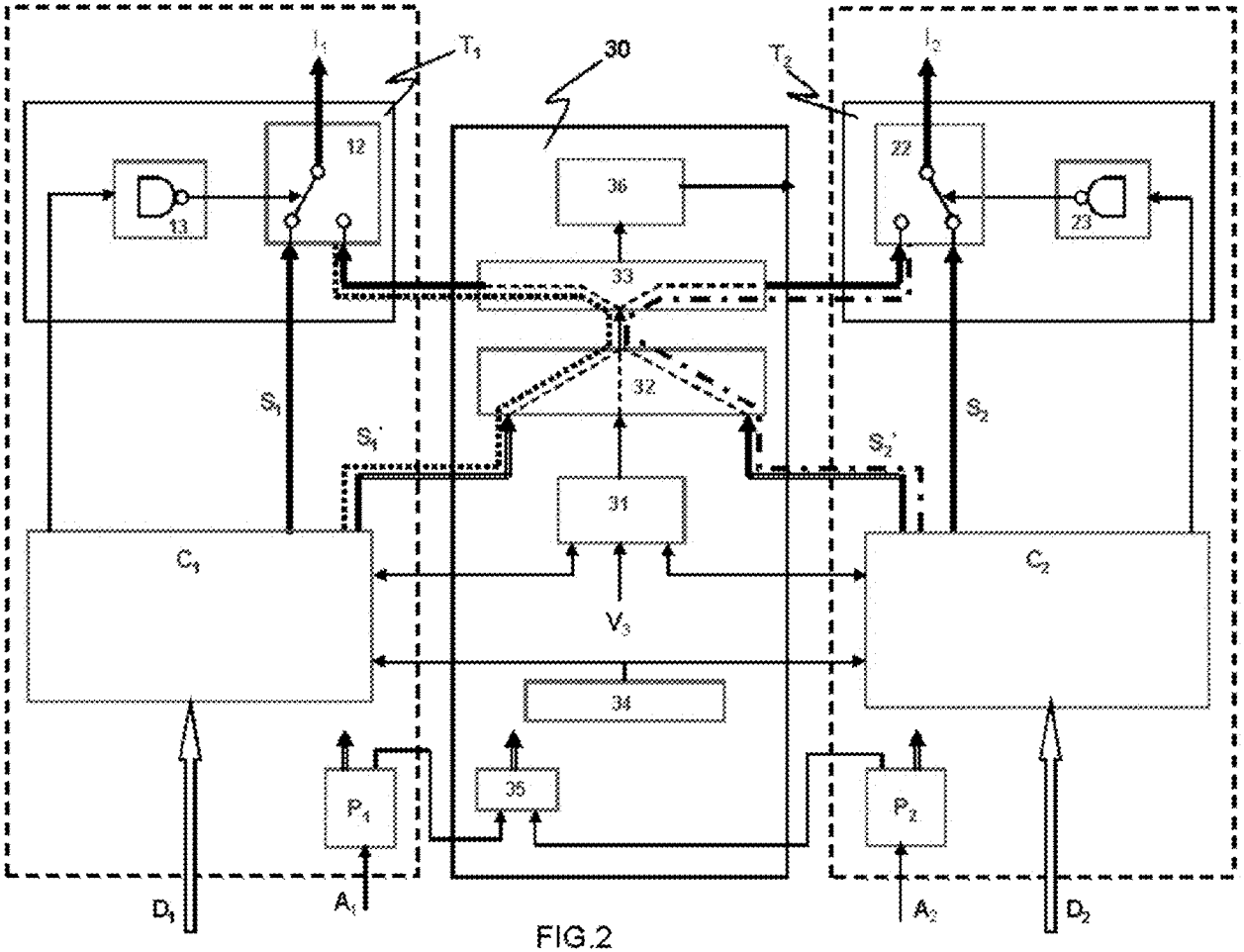

FIG. 2 illustrates the operating principle of the device according to the invention.

A first power supply unit $P_1$ powers the graphic channel $C_1$, the bypass function $T_1$, the light box subassembly $B_1$ and the half-screen $E_1$. The first power supply unit $P_1$ is linked to a first external power supply $A_1$.

Similarly, a second power supply unit $P_2$ powers the graphic channel $C_2$, the bypass function $T_2$, the light box subassembly $B_2$ and the half-screen $E_2$. The power supply unit $P_2$ is linked to a second external power supply $A_2$.

A third power supply unit 35 which powers the central module 30 is linked to the power supply unit $P_1$ and/or to the power supply unit $P_2$.

The graphic channel $C_1$ (respectively $C_2$) sends control signals to a control logic 13 (respectively 23), of which the output acts directly on a switching means 12 (respectively 13) of the bypass function $T_1$ (resp. $T_2$). These control signals are the combination of external signals, transmitted by an operator, the pilot for example, and internal signals, detailed below. They make it possible to switch from a full-screen display mode to a "full-dual" display mode by half-screen.

The central module 30 comprises a video acquisition function 31, a mixing function 32 known to those skilled in the art and a separation function 33. The central module 30 also comprises a synchronization function 34 and a control-management or monitoring function 36, detailed below. The synchronization function 34 will set the running rate for each of the graphic channels $C_1$, $C_2$. The assembly is powered by the separate power supply unit 35 or directly by the power supply unit $P_1$ or the power supply unit $P_2$.

The monitoring function 36 is linked to the graphic channels $C_1$ and $C_2$; it informs them of the correct operation of the central module 30, by indicating for example whether the power supply unit 35 is operating correctly, whether the mixing function 32 is operating correctly, or whether the separation means or unit 33 is operating correctly. On the basis of the data sent by the monitoring function 36, each graphic channel $C_1$ (respectively $C_2$) will be able to modify the control signals transmitted to the control logic 13 (respectively 23), in order to switch back automatically for example to full-dual mode if a malfunction is detected.

In full-dual mode, the graphic channel $C_1$ sends control signals to the control logic 13 so that the data originating from the display system will pass through the switching means 12 directly to the input $I_1$ of the half-screen $E_1$, following the path represented by the letter $S_1$ in FIG. 2. Similarly, the graphic channel $C_2$ sends control signals to the control logic 23 so that the data originating from the display system will pass through the switching means 22 directly to the input $I_2$ of the half-screen $E_2$, following the path represented by the letter $S_2$ in FIG. 2.

In full-screen display mode, the data originating from the display system $C_1$ and/or from the channel $C_2$ will be directed to the mixing function 32 in order to compose an image of the width of the screen E. The separation function 33 will cut the image into 2 portions, $L_1$, $L_2$, each of the portions $L_1$, $L_2$ corresponding to two data sets, which are transmitted respectively to the half-screen $E_1$ and to the half-screen $E_2$. This will produce a display of a full-screen image. The data in this case follow the paths $S'_1$ and $S'_2$. Since the graphic channels $C_1$, $C_2$ are run at a rate set by the synchronization function 34, it is possible to mix line by line the images generated by each of the graphic channels by means of the mixing function 32, without introducing latency between the channels and hence by ensuring the display of a coherent full-screen image.

When one of the channels $C_1$, $C_2$ detects a malfunction, for example, a loss of the synchronization function, or when it is informed of a malfunction detected by the monitoring function 36, as described above, the channel decides autonomously to switch to full-dual mode and sends an instruction to the bypass function associated therewith. Similarly, if one of the channels receives an external instruction to switch to full-dual mode, the instruction emanating from a pilot for example, it transmits its instruction to the bypass function independently of the opposite channel.

The redundancy of the power supplies and their appropriate distribution makes it possible to ensure that, in the event of loss of one of them, it will always be possible to display at least one image on a half-screen.

The arrangement and the independence of the channels make it possible to keep at least one half-screen operational in the event of a simple failure of any component of the display system, for example in the event of a failure of an electric power supply, of a graphic channel, of the central module 30, of an electronic control element of a light box or of a half-screen. In this way the crew keeps the display of the data on at least one half-screen out of two, which is acceptable for flight safety.

In an aircraft cockpit designed on the basis of 3 large screens, it will be advantageous to use 3 display systems as described above, provided that the display of the data is provided if one half-screen is faulty. Specifically, such a cockpit is generally equivalent to a cockpit of the prior art based on 6 independent displays.

Figure 3:
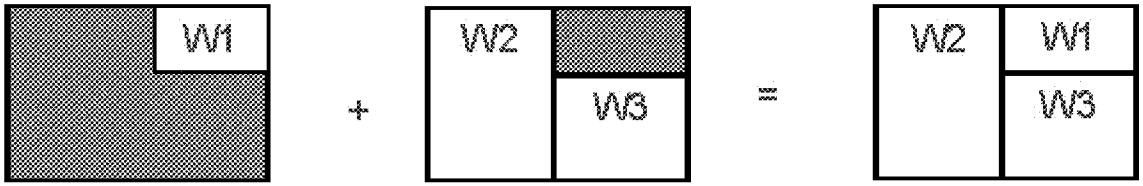

FIG. 3 illustrates a full-screen operating mode in which the graphic channel $C_1$ generates a first window $W_1$, the graphic channel $C_2$ generates the other two windows $W_2$ and $W_3$, the data corresponding to the generation of these three windows are assembled by the mixing function 32, before being distributed to the two half-screens by the separation function in order to form a full-screen image comprising the windows $W_1$, $W_2$, $W_3$.

Figure 4:
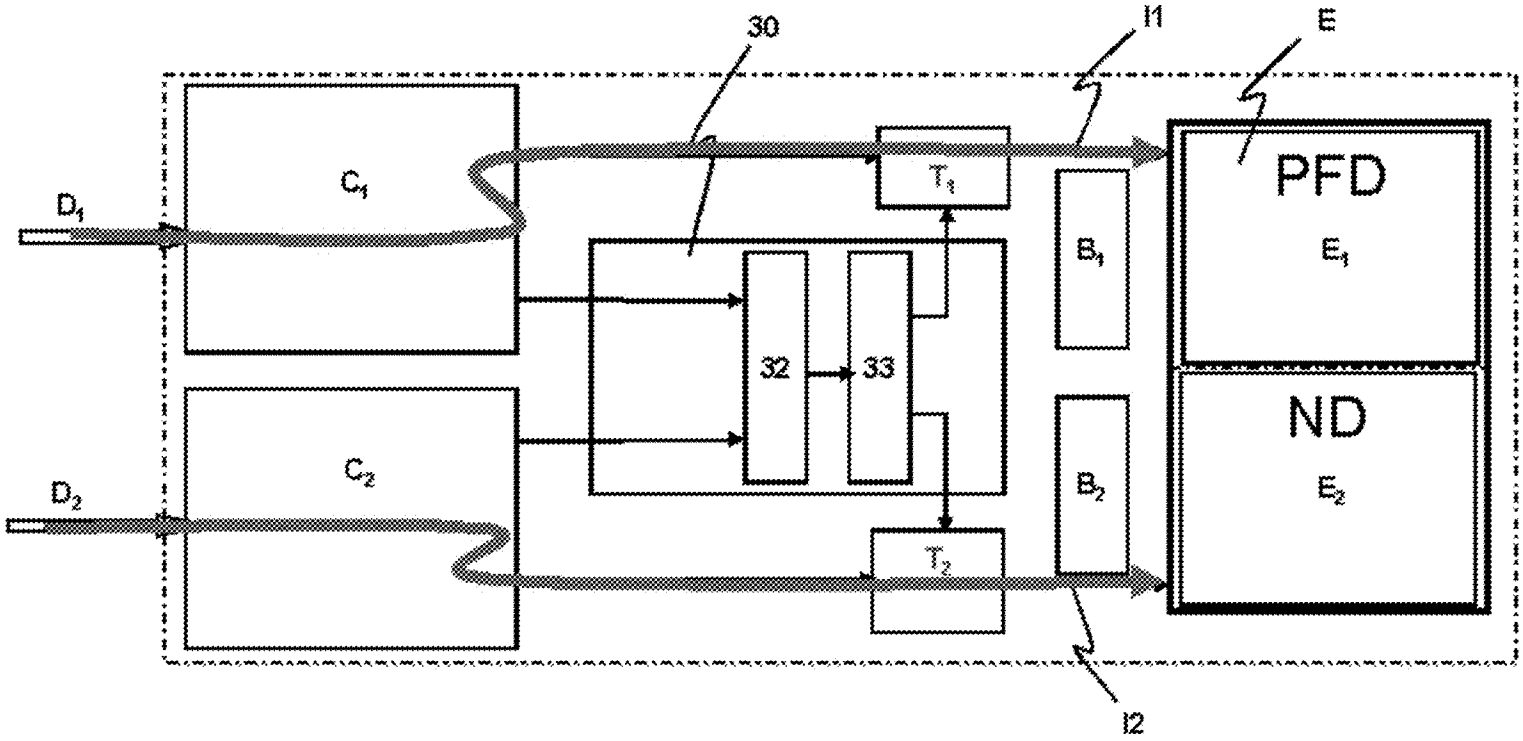

FIG. 4, illustrates another exemplary embodiment of the display system according to the invention operating in full-dual mode. In this example, the data $D_1$ used by the first graphic channel $C_1$ allow a PFD display only on the half-screen $E_1$. The data $D_2$ that can be different from the data $D_1$ and that are used by the second graphic channel $C_2$ allow an ND display on the second half-screen $E_2$.

Figure 5:
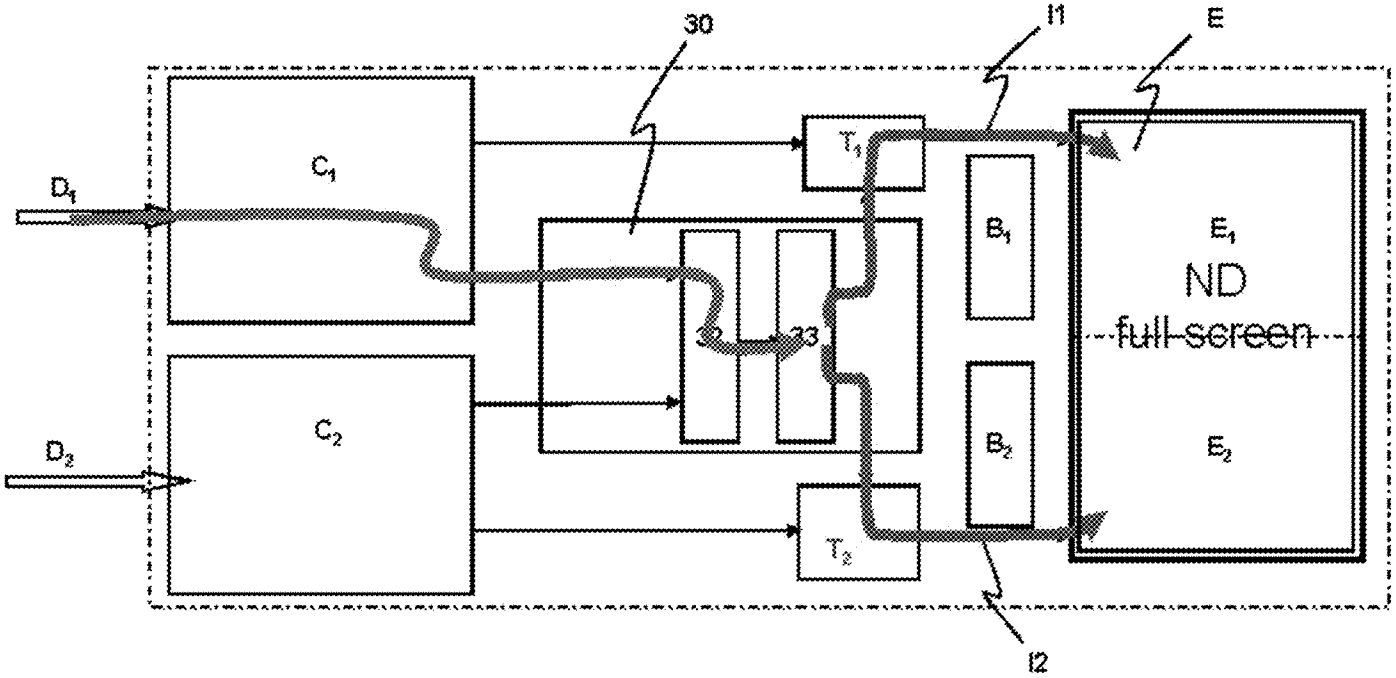

FIG. 5 illustrates another exemplary embodiment of a full-screen operating mode in which the data to be displayed are generated by a single graphic channel, in this example the channel $C_1$, in order to produce a full-screen ND display. In this example, the data produced by the channel $C_1$ are transmitted to the mixing and separation function which will transmit them via the bypass functions of each of the channels at the inputs $I_1$ and $I_2$ of the two half-screens in order to produce the full-screen display.

Figure 6:
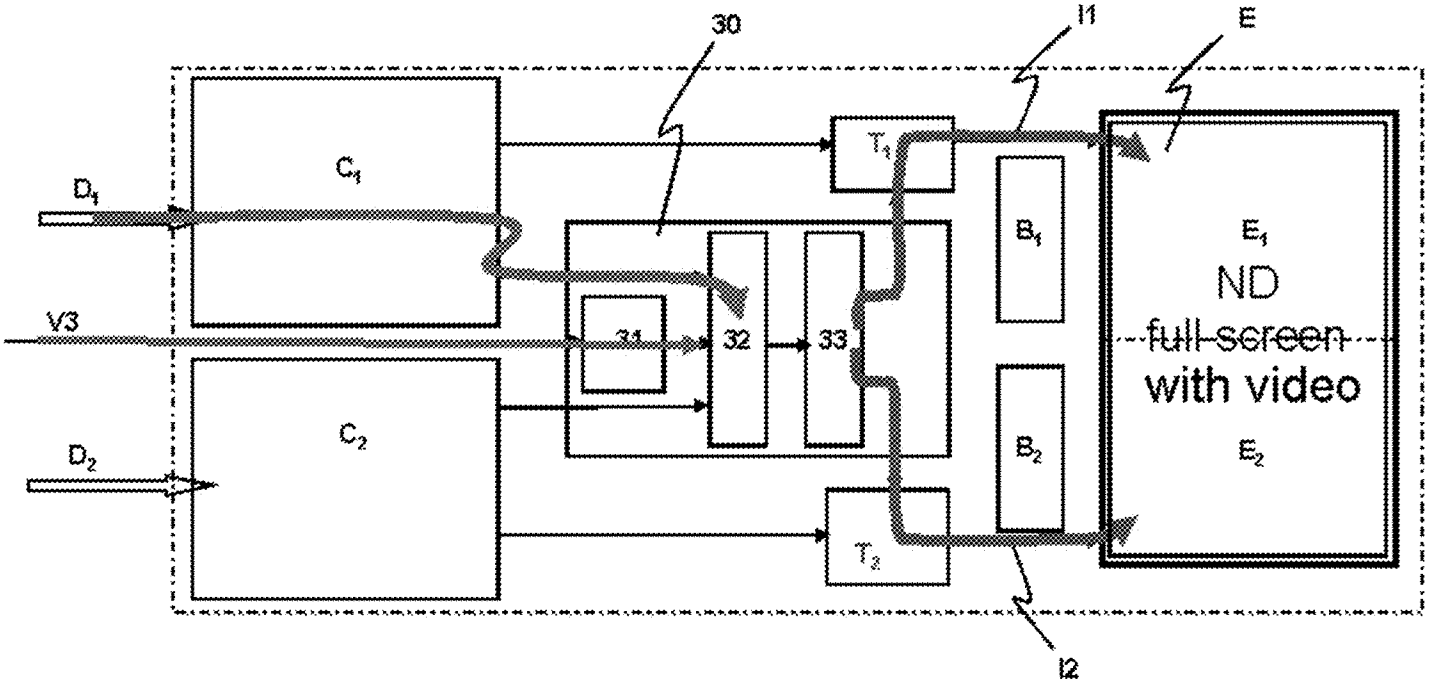
Figure 7:
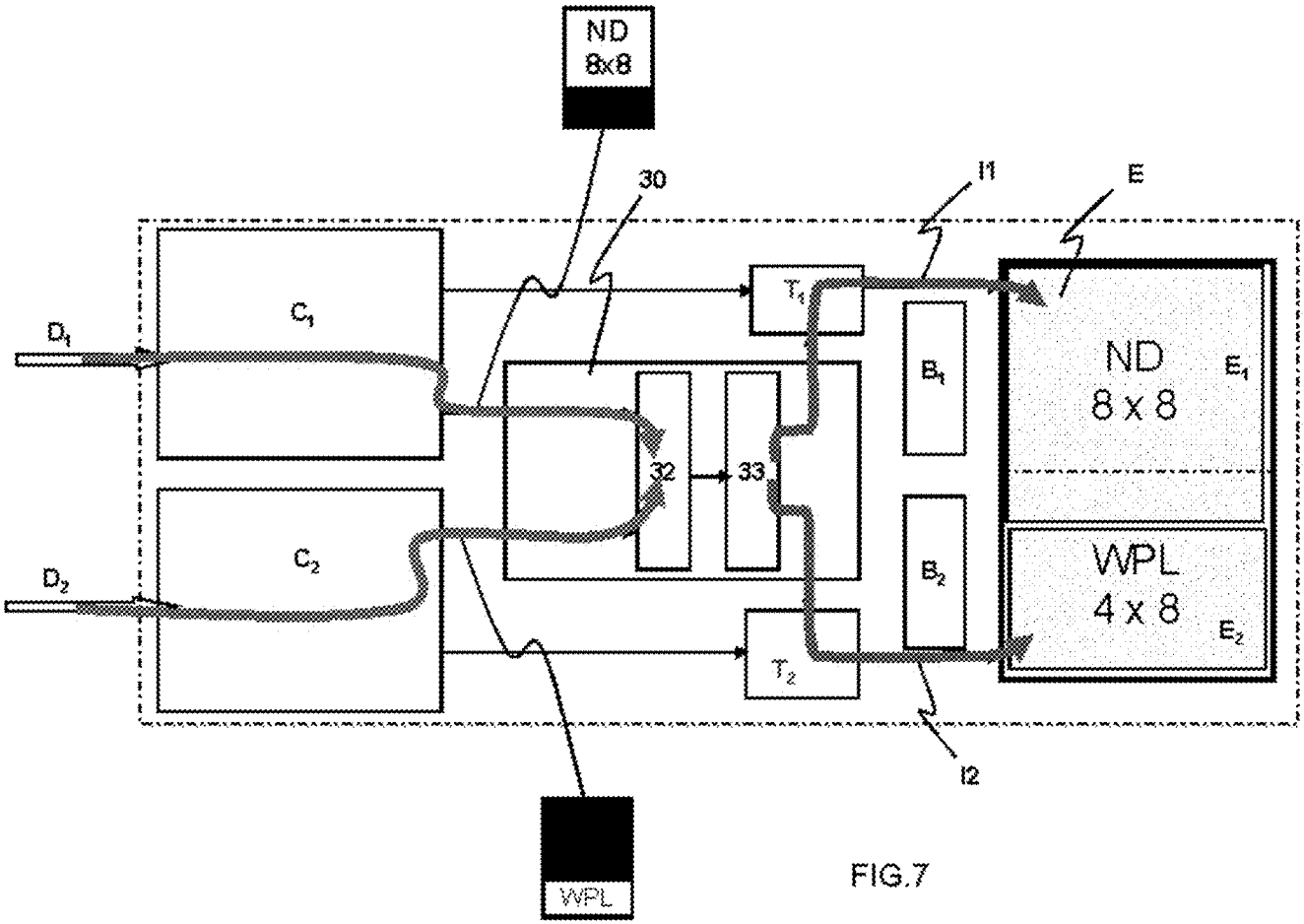

FIG. 6 illustrates another exemplary embodiment of a full-screen operating mode, in which the data to be displayed are generated by a single graphic channel, in this example the channel $C_1$, and combined with an external video $V_3$ in order to produce a full-screen ND display with background video. In this example, the data produced by the channel $C_1$ are transmitted to the mixing function, which also receives the video data acquired and transmitted by the video acquisition function 31. As in all the variants of the full-screen display mode, the separation function will separate the image into 2 half-images and transmit them via the bypass functions of each of the channels at the inputs $I_1$ and $I_2$ of the two half-screens in order to produce the full-screen display. In the example given in FIG. 6, the two display systems will generate complementary windows of different sizes. The ND window generated by the channel $C_1$ has a size of 8 inches by 4 inches and the WPL window generated by the channel $C_2$ has a size of 4 inches by 8 inches. These two windows complement one another so as to form a full-screen image which occupies the whole of the screen E.

The display system according to the invention notably provides the following advantages. The system according to the invention makes it possible to provide an item of display equipment that simultaneously has a full-dual operating mode and a full-screen operating mode, all without introducing a common failure mode that may lead, on a simple failure, to the loss of the whole screen. This solution also makes it possible to distribute the processing of graphic generation over the two available channels in order to form in the end a single full-screen image, which makes it possible to optimize the performance and to physically segregate two display functions. In the event of a simple failure of any of these elements forming it, the system allows the display of at least one image on one half-screen.

In the event of an implementation of the system in an aeroplane with only 3 screens, called double-channel, it is thus possible to obtain a degree of availability that is identical to that provided by the systems of the prior art comprising 6 display screens. Specifically, each display can function in full-dual mode, in which each graphic generation channel generates a half-image displayed on one half of the screen and does this completely independently of the other channel.

Moreover, in order to satisfy the needs of displaying new functions, each display can also operate in full-screen mode, in which each graphic generation channel generates one or more windows occupying all or part of the complete screen.

The invention claimed is:

1. A secure display system, comprising:

a display screen comprising at least two independent matrices formed of pixels, each of the matrices being controlled by an independent graphic channel, said matrices having independent inputs, a light box comprising at least two independent subassemblies, each subassembly backlighting a half-screen of the display screen, two bypass switches, each bypass switch connected on a one-to-one basis with one of the two graphic channels and controlled by the connected graphic channel, each bypass switch selectively connecting the input of each of the matrices to a signal output the graphic channel that controls the bypass switch or to the output of a central assembly, wherein the central assembly mixes images originating from the two independent graphic channels into a full screen image, separates the full screen image into half-screen portions, and outputs one of the separated half-screen portions to each of the bypass switches, wherein each graphic channel generates an image and outputs the image to a bypass switch and the central assembly, and a first power supply unit and a second power supply unit.

2. The system according to claim 1, further comprising a synchronization unit controlling synchronization between the two graphic channels.

3. The system according to claim 2, further comprising a monitoring unit connected to the graphic channels.

4. The system according to claim 2, further comprising a third power supply unit powering the central assembly.

5. The system according to claim 1, further comprising a monitoring unit connected to the graphic channels.

6. The system according to claim 1, further comprising a third power supply unit powering the central assembly.

7. The system according to claim 1, wherein said screen is a liquid crystal screen consisting of two independent matrices of pixels.

8. The system according to claim 1, wherein each graphic channel generates data allowing the independent display of two half-images on the two half-portions forming the screen.

9. The system according to claim 1, wherein a single graphic channel generates data allowing the display of a full-screen image on the two half-portions forming the screen.

10. The system according to claim 1, wherein each of the graphic channels generates data allowing a display on one or more windows distributed over the screen.

11. The system according to claim 1, wherein each of the graphic channels generates data allowing a display surface corresponding to the totality of the screen.

12. The system according to claim 1, comprising one, two, or three LCD screens.

* * * * *